US009293801B2

(12) United States Patent
Courtney et al.

(10) Patent No.: US 9,293,801 B2
(45) Date of Patent: Mar. 22, 2016

(54) POWER COMBINER

(71) Applicant: TriQuint CW, Inc., Hillsboro, OR (US)

(72) Inventors: Patrick Courtney, Newbury Park, CA (US); Scott Behan, Somis, CA (US)

(73) Assignee: TriQuint CW, Inc., Hillsboro, OR (US)

( * ) Notice: Subject to any disclaimer, the term of this patent is extended or adjusted under 35 U.S.C. 154(b) by 190 days.

(21) Appl. No.: 13/685,658

(22) Filed: Nov. 26, 2012

(65) Prior Publication Data

US 2014/0145794 A1 May 29, 2014

(51) Int. Cl.

| | |
|---|---|
| ***H01P 5/12*** | (2006.01) |
| ***H01Q 9/28*** | (2006.01) |
| *H01P 1/201* | (2006.01) |

(52) U.S. Cl.
CPC .. *H01P 5/12* (2013.01); *H01Q 9/28* (2013.01); *H01P 1/2016* (2013.01)

(58) Field of Classification Search
CPC ..... H01P 5/12; H01P 1/2016; H01Q 9/28
USPC ..... 333/125, 127, 128, 136, 137
See application file for complete search history.

(56) References Cited

U.S. PATENT DOCUMENTS

| | | | |
|---|---|---|---|
| 4,283,685 | A | 8/1981 | MacMaster et al. |
| 4,291,278 | A | 9/1981 | Quine |
| 4,302,734 | A | 11/1981 | Stockton et al. |
| 4,424,496 | A | 1/1984 | Nichols et al. |
| 4,588,962 | A | 5/1986 | Saito et al. |
| 4,782,346 | A | 11/1988 | Sharma |
| 4,925,024 | A | 5/1990 | Ellenberger et al. |
| 5,057,908 | A | 10/1991 | Weber |
| 5,142,253 | A | 8/1992 | Mallavarpu et al. |
| 5,214,394 | A | 5/1993 | Wong |
| 5,256,988 | A | 10/1993 | Izadian |
| 5,600,286 | A | 2/1997 | Livingston et al. |
| 5,736,908 | A | 4/1998 | Alexanian et al. |
| 5,920,240 | A | 7/1999 | Alexanian et al. |
| 6,028,483 | A | 2/2000 | Shealy et al. |

(Continued)

OTHER PUBLICATIONS

Abdulla, Mostafa N. et al., "A Full-Wave System Simulation of a Folded Slot-Spatial Power Combining Amplifier Array," 1999 IEEE MTT-S Digest, vol. 2, Jun. 1999, pp. 559-562.
Acharya, Pransy R. et al., "Tapered Slotline Antennas at 802 GHz," IEEE Transactions on Microwave Theory and Techniques, vol. 41, No. 10, Oct. 1993, pp. 1715-1719.
Alexanian, A. et al., "Broadband Spatially Combined Amplifier Array Using Tapered Slot Transitions in Waveguide," IEEE Microwave and Guided Wave Letters, vol. 7, No. 2, Feb. 1997, pp. 42-44.

(Continued)

*Primary Examiner* — Robert Pascal
*Assistant Examiner* — Kimberly Glenn
(74) *Attorney, Agent, or Firm* — Withrow & Terranova, P.L.L.C.

(57) ABSTRACT

A power combining apparatus includes an output waveguide section having inner and outer coaxial conductors, wherein an outer surface of the inner conductor and an inner surface of the outer conductor each includes a substantially linear taper, a center waveguide section having an input, an output, and a plurality of antenna elements, the output of the center waveguide section being coupled to the output waveguide section, and an output waveguide section coupled to the output of the center waveguide section. A power combining apparatus includes an output waveguide section having a central longitudinal axis, and inner and outer coaxial conductors configured to maintain a substantially constant characteristic impedance along the central longitudinal axis, a center waveguide section having an input, an output, and a plurality of antenna elements, the output of the center waveguide section being coupled to the output waveguide section, and an input waveguide section coupled to the input of the center waveguide section.

26 Claims, 4 Drawing Sheets

(56) References Cited

U.S. PATENT DOCUMENTS

| | | | | |
|---|---|---|---|---|
| 6,157,076 | A | 12/2000 | Azotea et al. | |
| 6,384,691 | B1 | 5/2002 | Sokolov | |
| 6,686,875 | B1 | 2/2004 | Wolfson et al. | |
| 7,215,220 | B1 | 5/2007 | Jia | |
| 7,482,894 | B2 | 1/2009 | Wu et al. | |
| 2008/0211726 | A1 | 9/2008 | Elsallal et al. | |
| 2013/0127678 | A1* | 5/2013 | Chandler | 343/731 |
| 2014/0145795 | A1 | 5/2014 | Behan et al. | |
| 2014/0167880 | A1 | 6/2014 | Daughenbaugh, Jr. et al. | |

OTHER PUBLICATIONS

Alexanian, Angelos et al., "Broadband Waveguide-Based Spatial Combiners," 1997 IEEE MTT-S Digest, vol. 3, Jun. 1997, pp. 1139-1142.

Alexanian, Angelos, "Planar and Distributed Spatial Power Combiners," Dissertation, Jun. 1997, 119 pages.

Chen, Lee-Yin V. et al., "Development of K-Band Spatial Combiner using Active Array Modules in an Oversized Rectangular Waveguide," Microwave Symposium Digest, 2000 IEEE MTT-S International, vol. 2, Jun. 2000, pp. 821-824.

Chen, Lee-Yin Victoria, "K-Band Spatial Combiner using Active Array Modules in an Oversized Rectangular Waveguide," Dissertation, Jun. 2003, 118 pages.

Chen, Lee-Yin V. et al., "K-band Spatial Combiner using Finline Arrays in Oversized Rectangular Waveguide," Proceedings of APMC2001, Taipei, Taiwan, R.O.C., 2001, pp. 807-810.

Cheng, Nai-Shuo et al., "20 Watt Spatial Power Combiner in Waveguide," 1998 IEEE MTT-S Digest, vol. 3, Jun. 1998, pp. 1457-1460.

Cheng, Nai-Shuo et al., "40-W CW Broad-Band Spatial Power Combiner Using Dense Finline Arrays," IEEE Transactions on Microwave Theory and Techniques, vol. 47, No. 7, Jul. 1999, pp. 1070-1076.

Cheng, Nai-Shuo et al., "Analysis and Design of Tapered Finline Arrays for Spatial Power Combining," Antennas and Propagation Society International Symposium, 1998 IEEE, vol. 1, 1998, pp. 466-469.

Cheng, Nai-Shuo et al., "Waveguide-Based Spatial Power Combining," 1998 National Radio Science Meeting, May 23, 1995, Form Version: 1.0, 1 page.

Cheng, Nai-Shuo, "Waveguide-Based Spatial Power Combiners," Dissertation, Aug. 1999, 107 pages.

Cheng, N. S. et al., "A 120-Watt X-Band Spatially Combined Solid-State Amplifier," IEEE Transactions on Microwave Theory and Techniques, vol. 47, No. 12, Dec. 1999, pp. 2557-2561.

Delisio, Michael P. et al., "Quasi-Optical and Spatial Power Combining," IEEE Transactions on Microwave Theory and Techniques, vol. 50, No. 3, Mar. 2002, pp. 929-936.

Harvey, J. et al., "Spatial Power Combining for High-Power Transmitters," IEEE Microwave, Dec. 2000, pp. 48-59.

Janaswamy, Ramakrishna et al., "Analysis of the Tapered Sloth Antenna," IEEE Transactions on Antennas and Propagation, vol. AP-35, No. 9, Sep. 1987, pp. 1058-1062.

Jeong, Jinho et al., "1.6- and 3.3W Power-Amplifier Modules at 24 GHz Using Waveguide-Based Power-Combining Structures," IEEE Transactions on Microwave Theory and Technique, vol. 48, No. 12, Dec. 2000, pp. 2700-2708.

Jeong, Jinho et al., "A 1.6 W Power Amplifier Module at 24 GHz Using New Waveguide-Based Power Combining Structures," Microwave Symposium Digest, 2000 IEEE MTT-S International, Jun. 2000, pp. 817-820.

Jia, Pengcheng, "A 2 to 20 GHz High Power Amplifier Using Spatial Power Combining Techniques," Microwave Journal, Apr. 2005, 4 pages.

Jia, Pengcheng et al., "A Compact Coaxial Waveguide Combiner Design for Ultra-Broadband Power Amplifiers," Microwave Symposium Digest, IEEE MTT-S 2001, vol. 1, May 2001, 4 pages.

Jia, Pengcheng et al., "Analysis of a Passive Spatial Combiner Using Tapered Slotline Array in Oversized Coaxial Waveguide," Microwave Symposium Digest, 2000 IEEE MTT-S International, vol. 3, Jun. 2000, pp. 1933-1936.

Jia, Pengcheng, "Broadband High Power Amplifiers Using Spatial Power Combing [sic] Technique," Dissertation, Dec. 2002, 151 pages.

Jia, Pengcheng et al., "BroadBand High Power Amplifier Using Spatial Power-Combining Technique," 2003 IEEE MTT-S Digest, 2003, pp. 1871-1874.

Jia, Pengcheng et al., "Broad-Band High-Power Amplifier Using Spatial Power-Combining Technique," IEEE Transactions on Microwave Theory and Techniques, vol. 51, No. 12, Dec. 2003, pp. 2469-2475.

Jia, Pengcheng et al., "Design of Waveguide Finline Arrays for Spatial Power Combining," IEEE Transactions on Microwave Theory and Techniques, vol. 49, No. 4, Apr. 2001, pp. 609-614.

Jia, Pengcheng et al., "Multioctave Spatial Power Combining in Oversized Coaxial Waveguide," IEEE Transactions on Microwave Theory and Techniques, vol. 50, No. 5, May 2002, pp. 1355-1360.

Liao, P. et al., "A 1 Watt X-Band Power Coupling Array Using Coupled VCOs," 1994 IEEE MTT-S Digest, vol. 2, May 1994, pp. 1235-1238.

Mottonen, Ville S., "Wideband Coplanar Waveguide-to-Rectangular Waveguide Transition Using Fin-Line Taper," IEEE Microwave and Wireless Components Letters, vol. 15, No. 2, Feb. 2005, pp. 119-121.

Rutledge, Daved B. et al.,"Failures in Power-Combining Arrays," IEEE Transactions on Microwave Theory and Techniques, vol. 47, No. 7, Jul. 1999, pp. 1077-1082.

Sabet, Kazem F. et al., "Fast Simulation of Large-Scale Planar Circuits Using an Object-Oriented Sparse Solver," 1999 IEEE MTT-S Digest, vol. 1, Jun. 1999, pp. 373-376.

Simons, Rainee N. et al., "Space Power Amplification with Active Linearly Tapered Slot Antenna Array," 1993 IEEE MTT-S Digest, vol. 2, Jun. 1993, pp. 623-626.

Simons, R. N. et al., "Non-Planar Linearly Tapered Slot Antenna with Balanced Microstrip Feed," Antennas and Propagation Society International Symposium, 1992, AP-S, 1992 Digest, IEEE, vol. 4, Jul. 1992, pp. 2109-2112.

York, Robert A. et al., "Coupled-Oscillator Arrays for Millimeter-Wave Power-Combining and Mode-Locking," 1992 IEEE MTT-S Digest, vol. 1, Jun. 1992, pp. 429-432.

York, Robert A. et al., "Quasi-Optical Power Combining Using Mutually Synchronized Oscillator Arrays," IEEE Transactions on Microwave Theory and Techniques, vol. 39, No. 6, Jun. 1991, pp. 1000-1009.

York, Robert A., "Some Considerations for Optimal Efficiency and Low Noise in Large Power Combiners," IEEE Transactions on Microwave Theory and Techniques, vol. 49, No. 8, Aug. 2001, pp. 1477-1482.

Non-Final Office Action for U.S. Appl. No. 10/925,330, mailed Dec. 5, 2005, 9 pages.

Non-Final Office Action for U.S. Appl. No. 10/925,330, mailed Jun. 14, 2006, 6 pages.

Quayle Action for U.S. Appl. No. 10/925,330, mailed Oct. 20, 2006, 5 pages.

Notice of Allowance for U.S. Appl. No. 10/925,330, mailed Feb. 12, 2007, 7 pages.

Non-Final Office Action for U.S. Appl. No. 13/685,661, mailed Sep. 25, 2014, 8 pages.

Non-Final Office Action for U.S. Appl. No. 13/685,661, mailed Apr. 21, 2015, 8 pages.

Non-Final Office Action for U.S. Appl. No. 13/719,167, Oct. 10, 2014, 7 pages.

Non-Final Office Action for U.S. Appl. No. 13/719,167, mailed May 6, 2015, 7 pages.

Notice of Allowance for U.S. Appl. No. 13/685,661, mailed Oct. 23, 2015, 8 pages.

Notice of Allowance for U.S. Appl. No. 13/719,167, mailed Nov. 6, 2015, 7 pages.

* cited by examiner

POWER COMBINER

FIELD

The invention relates to a device for spatially dividing and combining power of an EM wave using a plurality of longitudinally parallel trays. More particularly, the invention relates to a device for dividing and combining the EM wave by antenna elements provided within a coaxial waveguide cavity with matched impedance for reduced insertion loss.

BACKGROUND

The traveling wave tube amplifier (TWTA) has become a key element in broadband microwave power amplification for radar and satellite communication. One advantage of the TWTA is the very high output power it provides. However, several drawbacks are associated with TWTAs, including short life-time, poor linearity, high cost, large size and weight, and the requirement of a high voltage drive, imposing high voltage risks.

Solid state amplifiers are superior to TWTAs in several aspects, such as cost, size, life-time and linearity. However, currently, the best available broadband solid state amplifiers can only offer output power in a watt range covering about 2 to 20 GHz frequency band. A high power solid state amplifier can be realized using power combining techniques. A typical corporate combining technique can lead to very high combining loss when integrating a large number of amplifiers. Spatial power combining techniques are implemented with the goal of combining a large quantity of solid-state amplifiers efficiently and improving the output power level so as be competitive with TWTAs.

SUMMARY

In accordance with the invention, a power combining device uses antenna elements disposed inside a coaxial center waveguide section to spatially divide and combine a TEM (transverse electromagnetic) wave. The antenna elements, each of which is part of a wedge shaped tray, are combined into an array inside the center waveguide section formed by stacking the wedge shaped trays in parallel to form a coaxial waveguide. The center waveguide section may have active elements arranged with the antenna elements. Coaxial input and output waveguide sections interface external inputs and outputs to the center waveguide section. The input and output waveguide sections and the center waveguide section are spatially arranged to have substantially matched impedance from input to output.

In a further aspect of the disclosure, a power combining apparatus includes an output waveguide section having inner and outer coaxial conductors, wherein an outer surface of the inner conductor and an inner surface of the outer conductor each includes a substantially linear taper, a center waveguide section having an input, an output, and a plurality of antenna elements, the output of the center waveguide section being coupled to the output waveguide section, and an output waveguide section coupled to the output of the center waveguide section.

In a further aspect of the disclosure, a power combining apparatus includes an output waveguide section having a central longitudinal axis, and inner and outer coaxial conductors, wherein an outer surface of the inner conductor and an inner surface of the outer conductor have a substantially constant ratio of radial dimension along the central longitudinal axis, a center waveguide section having an input, an output, and a plurality of antenna elements, the output of the center waveguide section being coupled to the output waveguide section and an input waveguide section coupled to the input of the center waveguide section.

In a further aspect of the disclosure, a power combining apparatus includes an output waveguide section having a central longitudinal axis, and inner and outer coaxial conductors configured to maintain a substantially constant characteristic impedance along the central longitudinal axis, a center waveguide section having an input, an output, and a plurality of antenna elements, the output of the center waveguide section being coupled to the output waveguide section, and an input waveguide section coupled to the input of the center waveguide section.

BRIEF DESCRIPTION OF THE DRAWINGS

Many advantages of the present invention will be apparent to those skilled in the art with a reading of this specification in conjunction with the attached drawings, wherein like reference numerals are applied to like elements, and wherein.

DETAILED DESCRIPTION

The detailed description set forth below in connection with the accompanying drawings is intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without these specific details. In some instances, well known structures and components are shown in block diagram form in order to avoid obscuring the concepts of the invention.

In accordance with the invention, a broadband spatial power combining device has an input waveguide section, an output waveguide section, and a center waveguide section. The center waveguide section is provided with longitudinally parallel, stacked wedge shaped trays. Antenna elements are mounted on each tray. When the trays are stacked together to form a coaxial waveguide, the antenna elements are disposed into the waveguide and form a dividing array at the input and a combining array at the output. One or more active elements may be arranged between an antenna element of the input array and an antenna element of the output array. With the use of antenna elements inside the coaxial waveguide for power dividing and combining, a broadband frequency response covering the range of about 2 to 20 GHz may be realized. The antenna element is easy to manufacture using conventional printed circuit board (PCB) processes. It also enables easy integration with commercial off-the-shelf (COTS) millimeter wave integrated circuits (MMICs). Further, the division of a coaxial waveguide into wedge-shaped trays enables simplified DC biasing and provides good thermal management.

Figure 1:
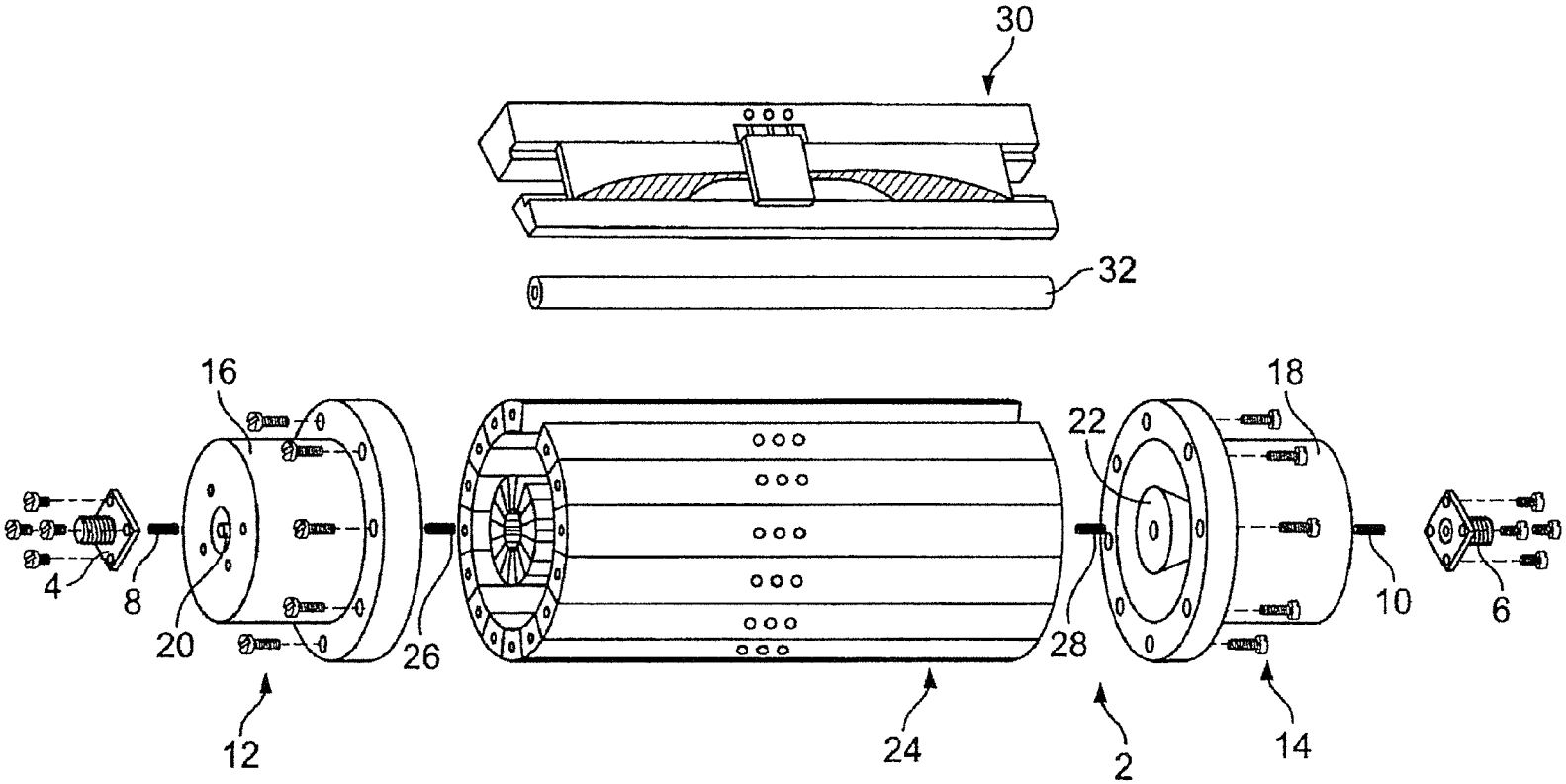
FIG. 1 is a perspective view of the power combining system in accordance with the invention.

As illustrated in FIG. 1, in the spatial power combining device 2 of the invention, an electromagnetic (EM) wave is launched from an input port 4 to an input coaxial waveguide section 12, then the EM wave is collected through an output coaxial waveguide section 14 to an output port 6. The input/output waveguide sections 12 and 14 provide broadband transitions from the input/output ports 4 and 6 to a center waveguide section 24. The outer surfaces of inner conductors 20 and 22 and the inner surfaces of outer conductors 16 and 18 all have gradually changed profiles. The profiles are determined to minimize the impedance mismatch from the input/output ports 4 and 6 to the center waveguide section 24.

In an embodiment, the outer surface of inner conductor 20 and the inner surface of the outer conductor 16 have profiles with a substantially linear taper.

In an embodiment, the outer surface of inner conductor 20 and the inner surface of outer conductor 16 have profiles with a substantially constant ratio of radial dimension along a common axis of the inner and outer coaxial conductors.

In an embodiment, the outer surfaces of inner conductor 20 and the inner surfaces of outer conductor 16 are configured to maintain a substantially constant characteristic impedance along a common axis.

In an embodiment, the outer surface of inner conductor 22 and the inner surface of the outer conductor 18 have profiles with a substantially linear taper.

In an embodiment, the outer surface of inner conductor 22 and the inner surface of outer conductor 18 have profiles with a substantially constant ratio of radial dimension along a common axis of the inner and outer coaxial conductors.

In an embodiment, the outer surfaces of inner conductor 22 and the inner surfaces of outer conductor 18 are configured to maintain a substantially constant characteristic impedance along a common axis.

In a preferred embodiment, the input/output ports 4 and 6 are field replaceable SMA (Subminiature A) connectors. The flanges of the input/output port 4 and 6 are screwed to the outer conductors 16 and 18 with four screws each, although that number is not crucial, and other types of fasteners may be used. Pins 8 and 10 are used to connect between centers of the input/output port 4 and 6 and inner conductors 20 and 22. In other embodiments, the input/output ports may be super SMA connectors, type N connectors, K connectors or any other suitable connectors. The pins 8 and 10 can also be omitted, if the input/output ports already have center pins that can be mounted into inner conductors 20 and 22.

The center waveguide section 24 comprises a plurality of trays 30 and a cylinder post 32 whose major longitudinal axis is coincident with a central longitudinal axis of the center waveguide section. The plurality of trays 30 are stacked circumferentially around the post 32. Each tray 30 includes a carrier 54 (FIG. 2) having a predetermined wedge angle $\alpha$ (FIG. 3), an arcuate inner surface 36 conforming to the outer shape of post 32, and arcuate outer surface 34. When the trays 30 are assembled together, they form a cylinder with a cylindrical central cavity defined by inner surfaces 36 which accommodates the post 32. Post 32 connects with inner conductors 20 and 22 of input/output waveguide sections 12 and 14 by way of screws 26 and 28 on opposite ends of the post. Post 32 is provided for simplifying mechanical connections, and may have other than a cylindrical shape, or be omitted altogether.

Figure 2:
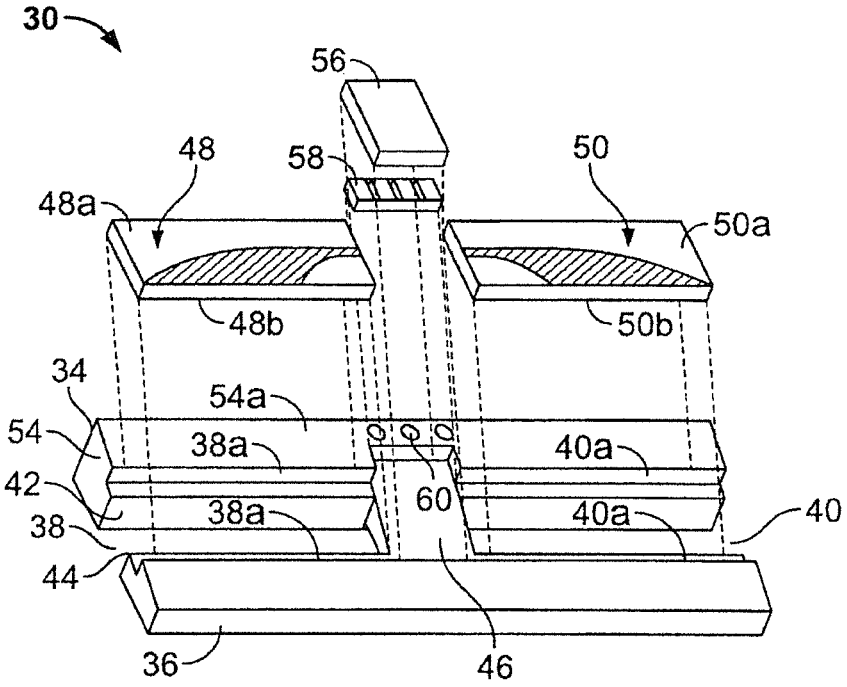
FIG. 2 is perspective view of a wedge shaped tray.

As detailed in FIG. 2, each tray 30 also includes an input antenna element 48, may include at least one active element 56, an output antenna element 50, and attendant DC circuitry 58. The metal carrier 54 has an input cut-out region 38 and an output cut-out region 40. The input and output cut-out regions are separated by a bridge 46. Opposing major surfaces 42 and 44 of the regions 38 and 40 are arcuate in shape. When the trays 30 are stacked together, the regions 38 and 40 form a coaxial waveguide opening defined by circular outer and inner surfaces corresponding to arcuate major surfaces 42 and 44, and the arrangement of the input and output antenna elements on carriers 54 is such that the antenna elements lie radially about the central longitudinal axis of center waveguide section 24. Alternatively, major surfaces 42 and 44 can be planar, rather than arcuate, such that the coaxial waveguide opening, in cross-section, will be defined by polygonal outer and inner boundaries corresponding to planar major surfaces 42 and 44.

The top surface 54*a* of metal carrier 54 is provided with recessed edges 38*a* and 40*a* in the periphery of cut-out regions 38 and 40, and is recessed at bridge 46, in order to accommodate the edges of antenna elements 48, 50, active elements 56 and DC circuitry 58. When in position in a first carrier 54, the back edges of antenna elements 48, 50 rest in the corresponding recessed edges 38*a*, 40*a* of the carrier 54, and back faces 48*b* and 50*b* of the antenna elements respectively face cut-out regions 38, 40 of that first tray. Contact between the back faces 48*b* and 50*b* of antenna elements 48, 50 and the corresponding recessed edges 38*a*, 40*a* of the carrier 54 provides grounding to the antenna elements.

Figure 4:
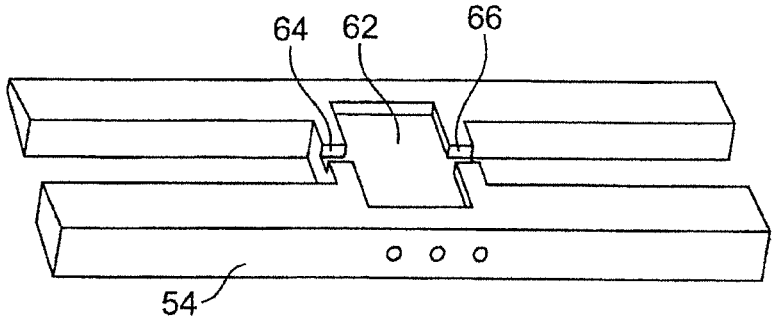
FIG. 4 is back side view of the wedge shaped metal carrier.

The back side of each carrier 54 has a cavity 62 as shown in FIG. 4, such that when the trays are stacked together, the cavity 62 will provide enough space to accommodate the active elements on the abutting tray and carrier. In the preferred embodiment, the cavity 62 is provided with channels 64 and 66 to avoid electrical contact with microstrip lines on the antenna elements of the abutting tray and carrier.

Figure 3:
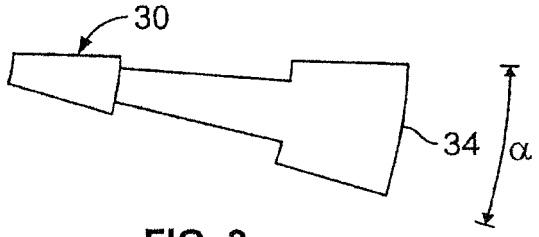
FIG. 3 is the cross section of a wedge shaped metal carrier.

FIG. 3 shows a cross section at the middle of a carrier 54. Outer surface 34 of the carrier is arcuate in shape such that when assembled together, the trays 30 provide the center coaxial waveguide section 24 with a substantially circular cross-sectional shape. It is contemplated that other outer surface shapes, such as planar shapes, can be used, in which case the outer cross-sectional shape of the center coaxial waveguide section 24 becomes polygonal (see FIG. 4A). Further, as mentioned above, the carrier has a predetermined wedge angle $\alpha$.

Figure 4A:
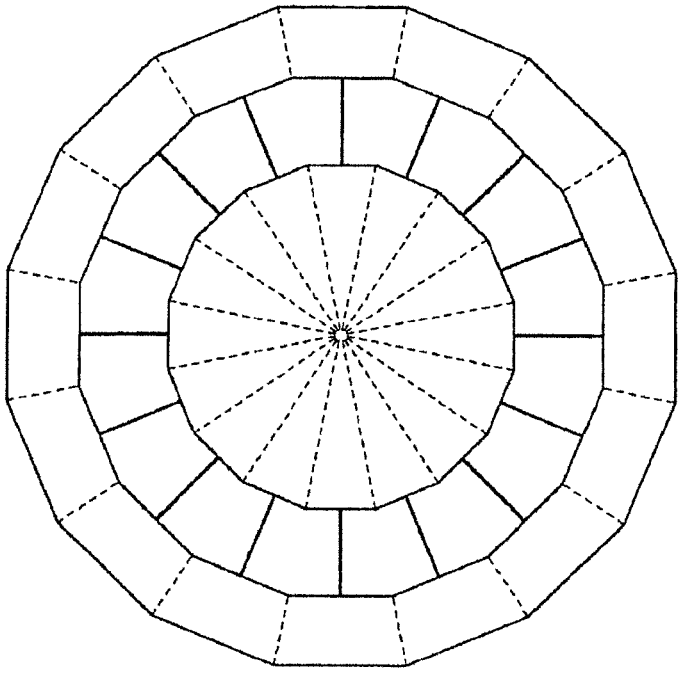
FIG. 4A is the cross section of center waveguide structure which has a plurality of planar surfaces.

While it is preferred that the outside surfaces 34, 36 of each carrier 54, along with the inside surfaces 42, 44 of the cut-out regions all be arcuate in shape so as to provide for circular cross-sections, it is possible to use straight edges for some or all of these surfaces, or even other shapes instead, with the assembled product thereby approximating cylindrical shapes depending on how many trays 30 are used. FIG. 4A shows an embodiment in which a cross section of the center waveguide shows that the outside surfaces and inside coaxial waveguide openings are all approximated by straight planes. A polygonal cross-sectional shape results, but if a sufficient number of trays are used, a circular cross section is approximated.

Figure 4B:
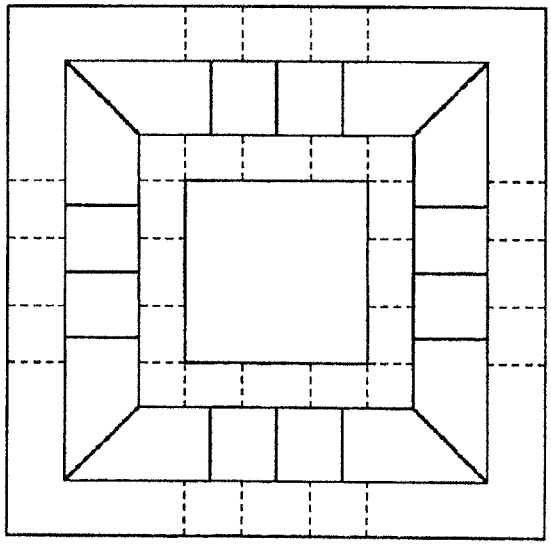
FIG. 4B is the cross section of center waveguide structure which has a rectangular outside profile and a rectangular coaxial waveguide opening.

In the preferred embodiment, the wedge shaped trays 30 are radially oriented when stacked together to form a circular coaxial waveguide, as seen schematically in FIG. 4A. However, the trays can have other shapes, which may be different from one another, and a non-cylindrical coaxial waveguide can thus result. FIG. 4B shows such an arrangement, resulting in a rectangular (square) coaxial waveguide. In FIGS. 4A and 4B, the bold solid lines represent the finline structures. The dashed lines represent the inter-tray boundaries.

Figure 5A:
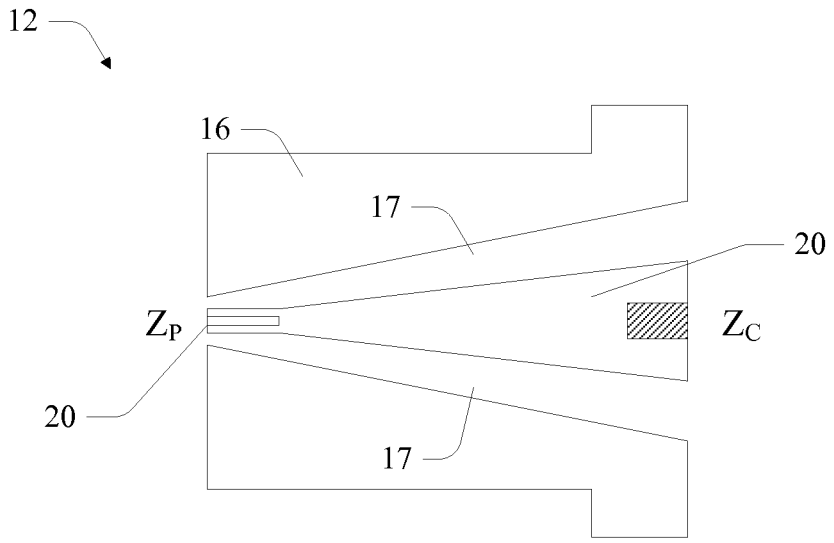
FIGS. 5A and 5B are longitudinal cross sections of the input/output waveguide section.
Figure 5B:
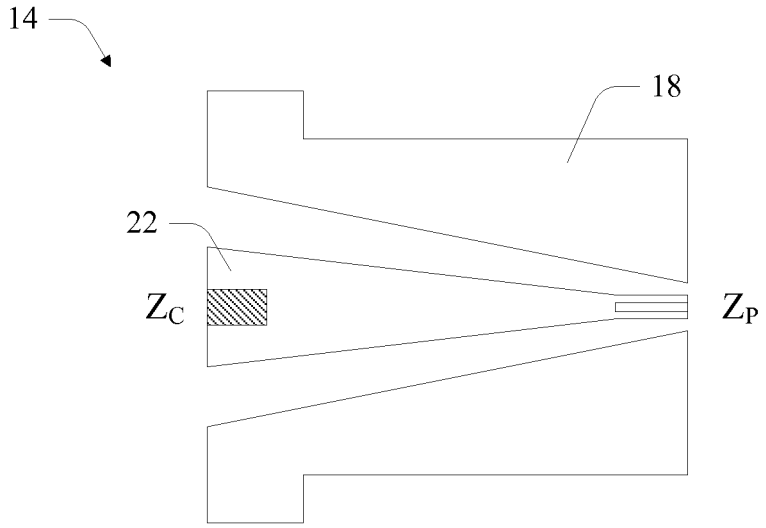

FIGS. 5A and 5B shows a longitudinal cross-sectional view of the input and output coaxial waveguide sections 12, 14. The waveguide section provides a smooth mechanical transition from a smaller input/output port (at Zp) to a flared center section 17. Electrically, the waveguide section provides broadband impedance matching from the input/output port impedance Zp to the center section waveguide impedance Zc. The profiles of the inner conductors and outer conductors are determined by both optimum mechanical and electrical transition in a known fashion. In an embodiment, the inner conductors 20, 22 and the outer conductor 16, 18 have linear tapered conical surfaces arranged concentrically along a central longitudinal axis. In this embodiment, Zp and Zc are substantially the same. In a further embodiment the radial dimension of inner surface of outer conductor 16 and the outer surface of the inner conductor 20 maintain a substantially constant ratio along the central longitudinal axis. In this embodiment, Zp and Zc are again substantially the same. In a further embodiment the inner and outer coaxial conductors are configured along the central longitudinal axis to maintain a substantially constant characteristic impedance Zp~Zc.

The number of trays 30, and corresponding number of antenna elements 48, 50, may be related to the impedance of the active elements 56 coupled to the antenna elements 48, 50. The receive and transmit antenna elements 48, 50 couple to the EM field at the input/output waveguide sections 12, 14. For example, where the output wave guide section 14 has a characteristic impedance of 50 ohms, the center waveguide section 24 includes 10 trays 30, where each tray 30 includes a transmit antenna element 50 that may have, e.g., a characteristic output impedance of 480 ohms, where the transmit antennas 50 are effectively in electrical parallel. The characteristic impedance of the array of 10 transmit antenna elements 50 is then effectively 48 ohms. Therefore, 10 may be the preferred number of trays, where each tray includes a single transmit antenna element 50 and a single receive antenna element 48. The output impedance of the transmit antenna element array is then said to be substantially matched to the output waveguide section, i.e., 48 ohms~50 ohms. The characteristic impedance of the transmit antenna element 50 is determined at least by the dielectric constant, thickness and planar dimensions of the substrate material of the transmit antenna element 50. Similarly, the input waveguide section 12 and the receive antenna elements 48 may be substantially impedance matched by the judicious design of the input waveguide section 12, receive antenna elements 48 and the number of trays 30 forming the center waveguide section 24 according to the description above for transmit antenna element 50 impedance matching.

Each antenna element 48, 50 may include a conductive pattern on either or both surfaces of the antenna element planar substrate to provide a broadband transition from a waveguide impedance, e.g., 480 ohms, to a microstrip impedance, which may preferably be substantially matched to the impedance of the active element 56 to further reduce insertion losses. Typically, an active element impedance may be about 50 ohms, but other impedance levels are possible. A profile of the conductive patterns on the antenna elements 48, 50 may be designed by well known principals, e.g., small reflection theory, to minimize reflection of the traveling EM wave. The profile of conductive patterns on the antenna elements 48, 50 is judiciously chosen to avoid exciting resonance at higher frequency and response deterioration at lower frequency.

It may be readily appreciated that the linear taper of the conductive surfaces of the input and output waveguide sections 12, 14 with consequent fixed ratio of the radial inner and outer surface dimensions to maintain a fixed impedance, is a simple design that may reduce the complexities of fabrication.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language of the claims, wherein reference to an element in the singular is not intended to mean "one and only one" unless specifically so stated, but rather "one or more." All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A power combining apparatus, comprising:

an input waveguide section having a central longitudinal axis, and having inner and outer coaxial conductors, wherein an outer surface of the inner coaxial conductor and an inner surface of the outer coaxial conductor have a substantially constant ratio of radial dimension along a central longitudinal axis;

a center waveguide section, coupled to the input waveguide section, having an input, an output, and a plurality of antenna elements; and an output coaxial waveguide section coupled to the output of the center waveguide section.

2. The apparatus of claim 1, wherein each of the outer surface of the inner conductor and the inner surface of the outer conductor comprises a substantially conical shape.

3. The apparatus of claim 1, wherein the antenna elements comprise a plurality of receive antenna elements associated with the input waveguide section and a plurality of transmit antenna elements associated with the output waveguide section.

4. The apparatus of claim 3, wherein the center waveguide section comprises a central longitudinal axis and a plurality of trays arranged circumferentially around the central longitudinal axis, wherein each of the trays include one of the receive antenna elements and one of the transmit antenna elements.

5. The apparatus of claim 4, wherein each of the trays further comprises at least one active element.

6. The apparatus of claim 4, wherein each of the trays further comprises an input antipodal finline structure including the receive antenna element for such tray and an output antipodal finline structure including the transmit antenna element for such tray.

7. The apparatus of claim 1, wherein the output waveguide section comprises inner and outer coaxial conductors, wherein an outer surface of the inner conductor of the output waveguide section and an inner surface of the outer conductor of the output waveguide section each comprises a substantially linear radial taper.

8. A power combining apparatus, comprising:

an input waveguide section having inner and outer coaxial conductors, wherein an outer surface of the inner coaxial conductor and an inner surface of the outer coaxial conductor each comprises a substantially rectilinear taper;

a center waveguide section having an input, an output, and a plurality of antenna elements, wherein the input waveguide section has a substantially constant characteristic impedance, and wherein the antenna elements are arranged such that the antenna elements have an effective combined impedance substantially equal to the characteristic impedance of the input waveguide section; and an output waveguide section coupled to the output of the center waveguide section.

9. A power combining apparatus, comprises:

an output waveguide section having a central longitudinal axis, and inner and outer coaxial conductors, wherein an outer surface of the inner conductor and an inner surface of the outer conductor have a substantially constant ratio of radial dimension along the central longitudinal axis;

a center waveguide section having an input, an output, and a plurality of antenna elements, the output of the center waveguide section being coupled to the output waveguide section; and an input waveguide section coupled to the input of the center waveguide section.

10. The apparatus of claim 9, wherein each of the outer surface of the inner conductor and the inner surface of the outer conductor comprises a substantially conical shape.

11. The apparatus of claim 9, wherein the outer surface of the inner conductor and the inner surface of the outer conductor each comprises a substantially rectilinear taper.

12. The apparatus of claim 9, wherein the antenna elements comprise a plurality of receive antenna elements associated with the input waveguide section and a plurality of transmit antenna elements associated with the output waveguide section.

13. The apparatus of claim 12, wherein the center waveguide section comprises a central longitudinal axis and a plurality of trays arranged circumferentially around the central longitudinal axis, wherein each of the trays include one of the receive antenna elements and one of the transmit antenna elements.

14. The apparatus of claim 13, wherein each of the trays further comprises at least one active element.

15. The apparatus of claim 13, wherein each of the trays further comprises an input antipodal finline structure including the receive antenna element for such tray and an output antipodal finline structure including the transmit antenna element for such tray.

16. The apparatus of claim 9, wherein:

the output coaxial waveguide section has a substantially constant characteristic impedance; and the antenna elements are arranged such that the antenna elements have an effective combined impedance substantially equal to the characteristic impedance of the output waveguide section.

17. The apparatus of claim 9, wherein the input waveguide section comprises inner and outer coaxial conductors, wherein an outer surface of the inner conductor of the input waveguide section and an inner surface of the outer conductor of the input waveguide section each comprises a substantial linear radial taper.

18. A power combining apparatus, comprising:

an output waveguide section having a central longitudinal axis, and having inner and outer coaxial conductors configured to maintain a substantially constant characteristic impedance along the central longitudinal axis, wherein an outer surface of the inner coaxial conductor and the inner surface of the outer coaxial conductor have a substantially constant ratio of radial dimension along the central longitudinal axis; wherein an outer surface of the inner coaxial conductor and the inner surface of the outer coaxial conductor have a substantially constant ratio of radial dimension along the central longitudinal axis;

a center waveguide section, coupled to the output waveguide section, having an input, an output, and a plurality of antenna elements, the output of the center waveguide section being coupled to the output waveguide section; and an input waveguide section coupled to the input of the center waveguide section.

19. The apparatus of claim 18, wherein each of the outer surface of the inner conductor and the inner surface of the outer conductor comprises a substantially conical shape.

20. The apparatus of claim 18, wherein the antenna elements comprise a plurality of receive antenna elements associated with the input waveguide section and a plurality of transmit antenna elements associated with the output waveguide section.

21. The apparatus of claim 20, wherein the center waveguide section comprises a central longitudinal axis and a plurality of trays arranged circumferentially around the central longitudinal axis, wherein each of the trays include one of the receive antenna elements and one of the transmit antenna elements.

22. The apparatus of claim 21, wherein each of the trays further comprises at least one active element.

23. The apparatus of claim 21, wherein each of the trays further comprises an input antipodal finline structure including the receive antenna element for such tray and an output antipodal finline structure including the transmit antenna element for such tray.

24. The apparatus of claim 18, wherein the output waveguide section comprises inner and outer coaxial conductors, wherein an outer surface of the inner conductor of the output waveguide section and an inner surface of the outer conductor of the output waveguide section each comprise a substantially linear radial taper.

25. The apparatus of claim 18, wherein the outer surface of the inner conductor and the inner surface of the outer conductor each comprises a substantially rectilinear taper.

26. A power combining apparatus, comprising:

an output waveguide section having a central longitudinal axis, and having inner and outer coaxial conductors configured to maintain a substantially constant characteristic impedance along the central longitudinal axis;

a center waveguide section, coupled to the output waveguide section, having an input, an output, and a plurality of antenna elements, the output of the center waveguide section being coupled to the output waveguide section, wherein the antenna elements are arranged such that the antenna elements have an effective combined impedance substantially equal to the characteristic impedance of the output waveguide section: and an input waveguide section coupled to the input of the center waveguide section.

* * * * *